US006588238B1

(12) United States Patent
Reason

(10) Patent No.: US 6,588,238 B1
(45) Date of Patent: Jul. 8, 2003

(54) LAUNDRY APPARATUS

(76) Inventor: Andrew Martin Reason, Alit-y-Mor, Haverford West, Pembrokeshire (GB), SA62 5UX ( * ) Notice: Subject to any disclaimer, the term of this patent is extended or adjusted under 35 U.S.C. 154(b) by 0 days.

(21) Appl. No.: 09/786,299

(22) PCT Filed: Sep. 6, 1999

(86) PCT No.: PCT/GB99/02941

§ 371 (c)(1),
(2), (4) Date: May 3, 2001

(87) PCT Pub. No.: WO00/14322

PCT Pub. Date: Mar. 16, 2000

(30) Foreign Application Priority Data

Sep. 5, 1998 (GB) ..... 9819324
Aug. 4, 1999 (GB) ..... 9918238

(51) Int. Cl.[7] ..... D06F 37/26

(52) U.S. Cl. ..... 68/24; 68/58; 68/142; 68/210

(58) Field of Search ..... 68/12.02, 12.16, 68/12.01, 210, 24, 58, 142; 34/126, 573

(56) References Cited

U.S. PATENT DOCUMENTS 653,581 A * 7/1900 Mather
2,180,225 A * 11/1939 Dewhurst
2,526,002 A * 10/1950 Brotman
2,643,536 A * 6/1953 Neher
2,783,551 A * 3/1957 Giannini
2,817,501 A * 12/1957 Schubert
2,872,802 A * 2/1959 Bellman
2,904,897 A * 9/1959 Whyte et al.
3,011,327 A * 12/1961 Brownell
3,134,203 A * 5/1964 Roberts
3,364,588 A * 1/1968 Ziegler
3,416,437 A * 12/1968 Drace et al.
3,596,481 A * 8/1971 Wilcox
5,007,255 A * 4/1991 Brazzoli
5,438,766 A * 8/1995 Nakamura
5,570,597 A * 11/1996 Bongini et al.
5,893,323 A * 4/1999 Ishii et al.

FOREIGN PATENT DOCUMENTS

BE 647318 * 8/1964
CA 464115 * 4/1940
DE 2206039 * 8/1973

* cited by examiner

*Primary Examiner*—Frankie L. Stinson
(74) *Attorney, Agent, or Firm*—Philip M. Weiss; Weiss & Weiss

(57) ABSTRACT

An apparatus comprising an outer casing with a base, at least one side wall, and a top, within which are located a drum, typically with a curved side wall and first and second end walls, an agitator and a liquid retainer. The liquid retainer and a side wall having aligned ports through which an end portion of the drum may reversibly travel between a first retracted position and a second extended position. The travel of the drum out of the side wall to the extended position allows access to at least one aperture in the curved side wall of the drum.

10 Claims, 7 Drawing Sheets

LAUNDRY APPARATUS

This invention relates to laundry, apparatus, and in particular laundry apparatus that are loaded and unloaded in a substantially horizontal direction.

Laundry apparatus that is loaded and unloaded in a substantially horizontal direction is often called "front loading". Most typically this apparatus is one of or a combination of a washing machine, tumble dryer and/or spin dryer.

Conventional front loading laundry apparatus have a hinged door located on a substantially vertical face of the apparatus. This has the benefit that it allows the apparatus to be placed under a solid surface such as a work top in a kitchen or the like. The problem with front loading apparatus is that use of such a machine requires the user to bend down when loading and unloading the apparatus; the laundry is then either pushed into or pulled out of the apparatus. This combination of bending and pushing/pulling can be painful and difficult for people with back problems, the infirm or the elderly.

In EP-A-0050395 an apparatus for handling laundry is proposed. That apparatus is an industrial sized washing machine which is filled and emptied by way of pneumatically driven drawers which contain the items to be laundered, and which are extended from the casing of the apparatus. Each drawer includes a compartment that is substantially half a cylinder (when cut in a plane passing through the longitudinal axis of the cylinder); the two compartments face each other so as to form a cylinder, the compartments are divided one from the other by internal walls so that two different washes can be performed at the same time. This apparatus allows the vertical loading and unloading of the laundry. The apparatus disclosed in EP-A-0050395 is not, however, suitable for adaptation to a domestic scale, is complicated in construction and operation, and because of its two chamber construction impractical in use as, to balance the drum, both drawers have to be equally loaded. This is not always possible in a domestic situation.

According to the present invention there is provided a laundry apparatus. The laundry apparatus comprises an outer casing with a base, at least one side wall and a top within which are located a receptacle for items to be laundered, a means for agitation of said items, a liquid or fluid retention means at least partially surrounding said receptacle, and control means. In the apparatus, the receptacle is a drum with a curved side wall and first and second end walls, the liquid retention means and a side wall are provided with aligned ports through which an end portion of the drum may reversibly travel between a first withdrawn position and a second extended position, the distance of travel of the end of the drum out of the side wall to the extended position being sufficient to allow access to at least one aperture in the curved side wall of the drum, said aperture is configured and dimensioned to allow insertion and removal of the items to be laundered, and the direction of travel of the drum is substantially parallel to the longitudinal axis of the drum.

The drum may be substantially cylindrical, or of a substantially frustoconical shape. If the drum is substantially frustoconical, it is preferred that the wider end of the drum travels out of the casing when the drum moves to the extended position.

The advantage of the present invention is that because of its configuration, when the aperture in the drum is in such a position to allow insertion and removal of items to be laundered from the drum, the insertion and removal can be done in a substantially vertical direction. This involves much less bending and twisting for the user than earlier known front loading machines. The apparatus of the present invention is suitable for either domestic or industrial (e.g. with greater loads than encountered domestically) use.

In a particularly preferred embodiment of the present invention, the drum and/or the aligned ports are configured so that the end portion of the drum can only travel through the aligned ports when the drum has a predetermined orientation relative to the outer casing. It is preferred that this feature allows the drum only to be able to pass through the aligned ports when the aperture through the curved side wall of the drum is substantially in the nearest or furthest portion of the drum from the top of the casing (at the highest or lowest part of the drum when the apparatus is positioned for use). This allows either convenient filling of the drum (when the aperture is in the portion of the drum nearest the top of the casing) or convenient emptying of the drum (when the aperture is in the portion of the drum most distant from the top of the casing). This embodiment is particularly beneficial to people with back problems or the elderly and infirm because it requires very much less agility on the part of the user. In particular when the laundry is being emptied from the drum, gravity will perform the majority of the work and require little intervention, if any, from the user.

The liquid retaining means, the drum of the drum actuation means may be provided with indexing means to cause the drum to be correctly orientated to pass through the port at the completion of laundering the items that were to be laundered.

It is preferred that at least one aperture in the drum is provided with reversible aperture closure means, said closure means being actuated by movement of the drum between the withdrawn and extended positions. The closure means preferably causes the aperture to be opened when the drum moves into the extended position, and closed when the drum moves into the withdrawn position.

It is preferred that a portion of at least one of the walls of the drum is adapted to allow the passage of liquid through that portion of the wall. Preferably, that portion of the wall is formed from netting, wire mesh, perforated metal sheet or metal sheet provided with one or more apertures. Most preferably the holes, apertures or perforations through which the liquid may flow are so dimensioned that the items to be laundered cannot fit through said holes, apertures or perforations.

The drum may be formed of walls of one or more layers. The composition of each of the layers may be different.

The ability of liquid so flow into and out of the drum allows for washing or draining of the items to be laundered. When the apparatus is being used for washing the items to be laundered, the liquid retention means holds the liquid that is used for washing said items, with said items being immersed in said liquid whilst within the drum. The drum may be rotated to agitate the items to be laundered. The general construction of laundry apparatus incorporating an inner drum within which the items to be laundered are retained, and a liquid retaining means within which the liquid to wash those items is kept is a standard construction and will not be further described herein. laundered.

It is most preferred that the drum is supported within the liquid retaining means by one or more drum support means. The drum support means preferably allow the drum to move both in the direction of the longitudinal axis of the drum, and to move so as to agitate the items to be laundered. In one embodiment, the or each of said drum support means is preferably a support bar substantially parallel to the central axis of the drum. The or each support bar is preferably engaged with either the curved side wall of the drum or the peripheral edge of the first and second end walls of the drum.

It is particularly preferred that the support bars are either telescopic or engaged with the drum in such a fashion that movement of the drum from its withdrawn to extended position is possible.

Most preferably the support bars are three in number, and located at 120° spacing about the periphery of the drum, with this configuration of support bars, the drum is preferably provided with one aperture spaced evenly between two support bars, and the end of the drum may only pass through the aligned ports when the aperture is in the portion of the drum that is vertically upwards when the apparatus is orientated for use.

The drum can be supported in other fashions from that described above. For example, the drum supported by engagement of the first or second end wall of the drum with drum support means.

A further advantage of the present invention is that, unlike currently known front loading machine, the contents of the drum, can be easily viewed by a user. This enables the drum to be efficiently filled and, once the laundry has been done, completely emptied.

The liquid retention means and side wall of the casing are provided with means to close the aligned ports, especially when the apparatus is in use. Said means preferably form a water-tight seal with the edges defining the ports.

In a preferred embodiment of the present invention the movement of the end of the drum through the aligned ports occurs simultaneously with the port closure means disengaging from the edges that define the aperture and moving away from the port.

In a most preferred embodiment, the drum and the port closure means are all supported on two or more support bars that are orientated in a direction substantially perpendicular to the face of the casing. In this embodiment, the port closure means retains its orientation relative to the drum when the drum is in the extended position.

In one embodiment of the present invention there is further provided a reversibly extending drip tray that extends beneath the drum and between the casing of the apparatus and the port closure means when the drum is in its extended position. Said drip tray can, when the drum is in its retracted position and the port closure means in a position to closure the port, be stored in a concertina fashion; other storage configurations for the drip tray are also possible.

In an alternative, the port closure means may be hinged to the outer casing of the laundry apparatus. The hinging can be arranged so that the closure means preferably swings around either a vertical axis or around a substantially horizontal axis when the apparatus is installed. Where the port closure means swings around a substantially horizontal axis, the port closure means can, if the hinges are situated at the lower portion of the port (when the apparatus is installed), act as a drip tray.

The present invention will be further described and explained by way of example with reference to the accompanying drawings in which.

Figure 1:
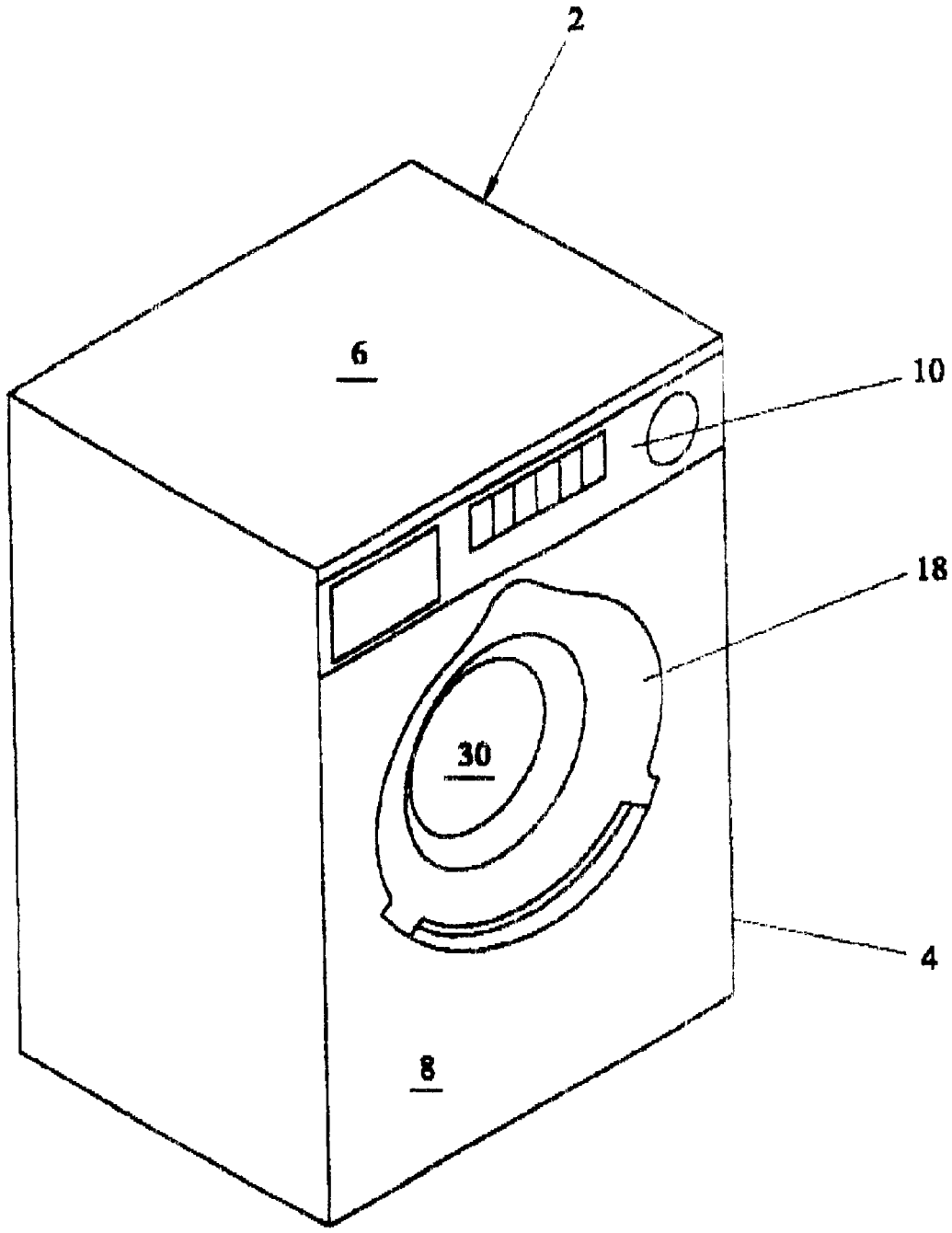
FIG. 1 shows an embodiment of the present invention with the drum in withdrawn position.

Referring to FIG. 1, a washing machine (2) includes a casing (4) which includes a top panel (6) and front panel (8). Mounted on front panel (8) in washing machine control panel (10).

Located within casing (4) are a drum (12), and at liquid retention means (14). Front panel (8) is provided with a port (16), defined by edges of panel (8), and of substantially the same dimensions and configuration as a mouth to liquid retaining means (14) which is aligned with port (16).

Figure 2:
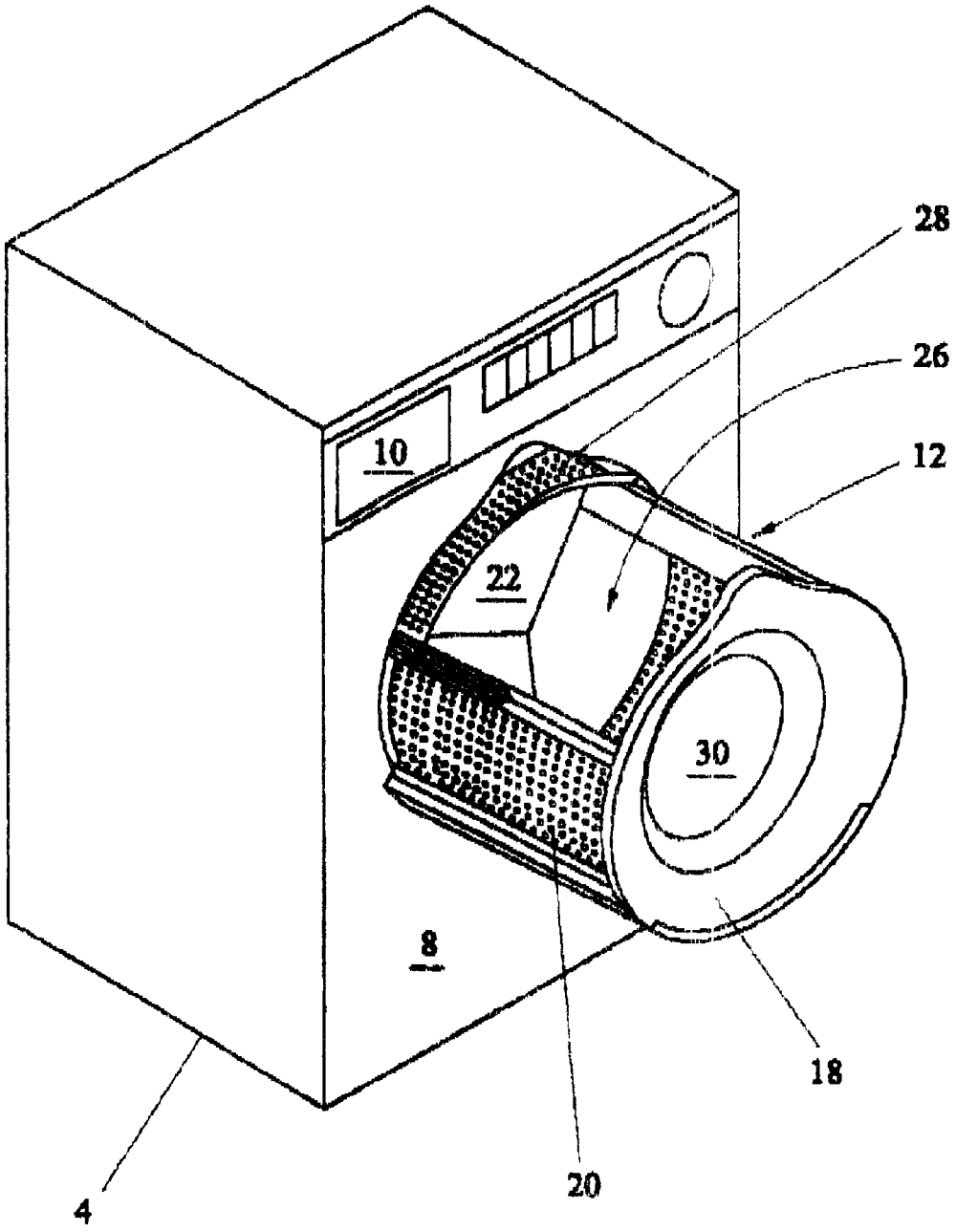
FIG. 2 shows the apparatus of FIG. 1 with the drum in extended position.
Figure 3:
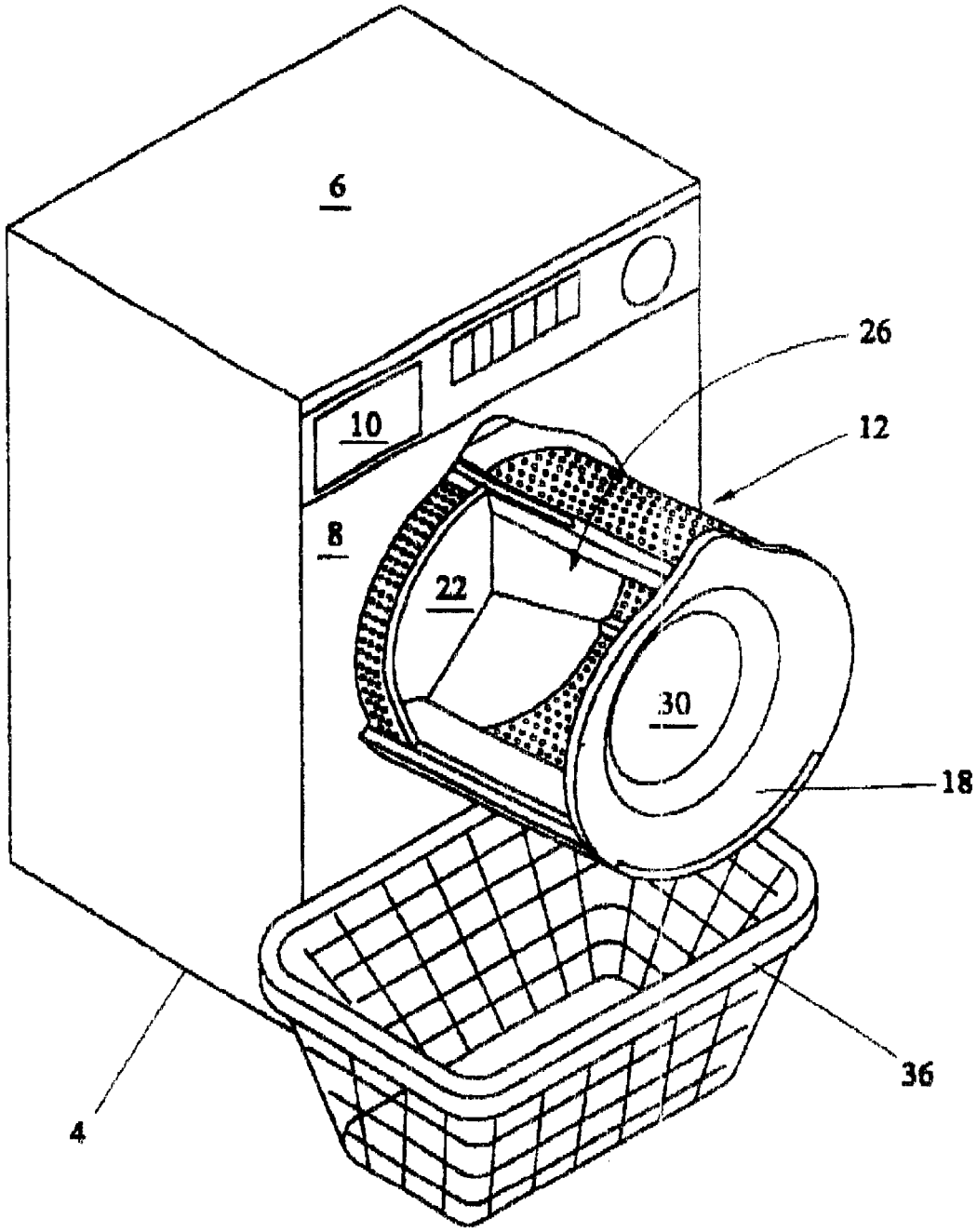
FIG. 3 shows a second view of the apparatus of FIG. 1 with the drum in extended position.
Figure 4:
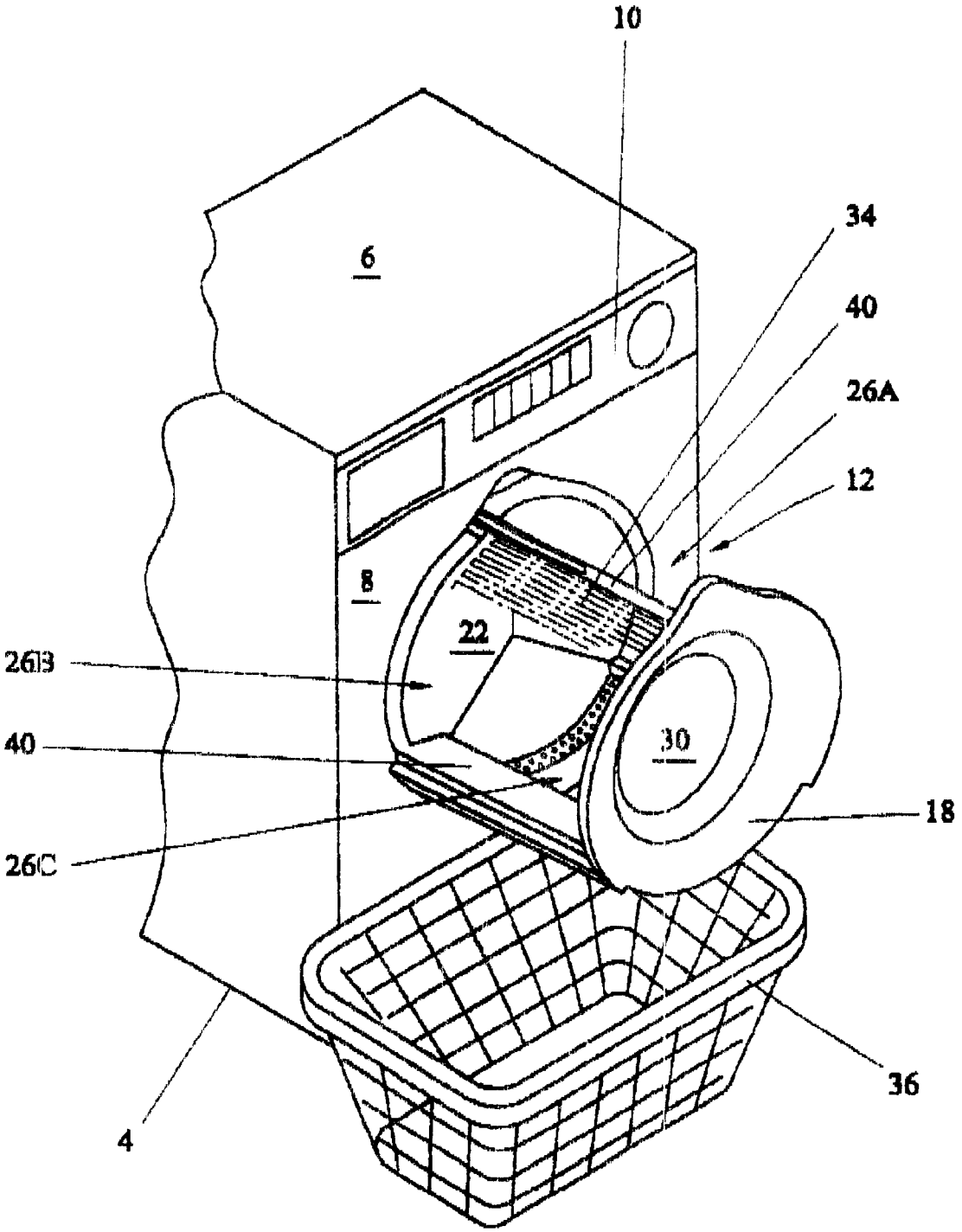
FIG. 4 shows the apparatus of FIG. 1 with a differently configured drum in extended position.

Drum (12) may move between a first withdrawn position as shown in FIG. 2 and a second extended position as shown in FIGS. 2, 3 and 4. When drum (12) is in its withdrawn position, port closure means (18) engages with the edges of front panel (8) defining port (16). The edges of front panel (8) defining port (16) and/or the appropriate portions of port closure (18) are provided with seal means (not shown) to enable a liquid-tight seal to be made between the front panel (8) and port closure (18). In similar fashion, unshown seal means are provided to provide a liquid-tight seal between liquid retaining means (14) and front panel (8). In an alternative embodiment of the present invention, the portion of the liquid retaining means (14) adjacent to port (16) may engage with port closure means (18), with a liquid-tight seal.

Figure 5:
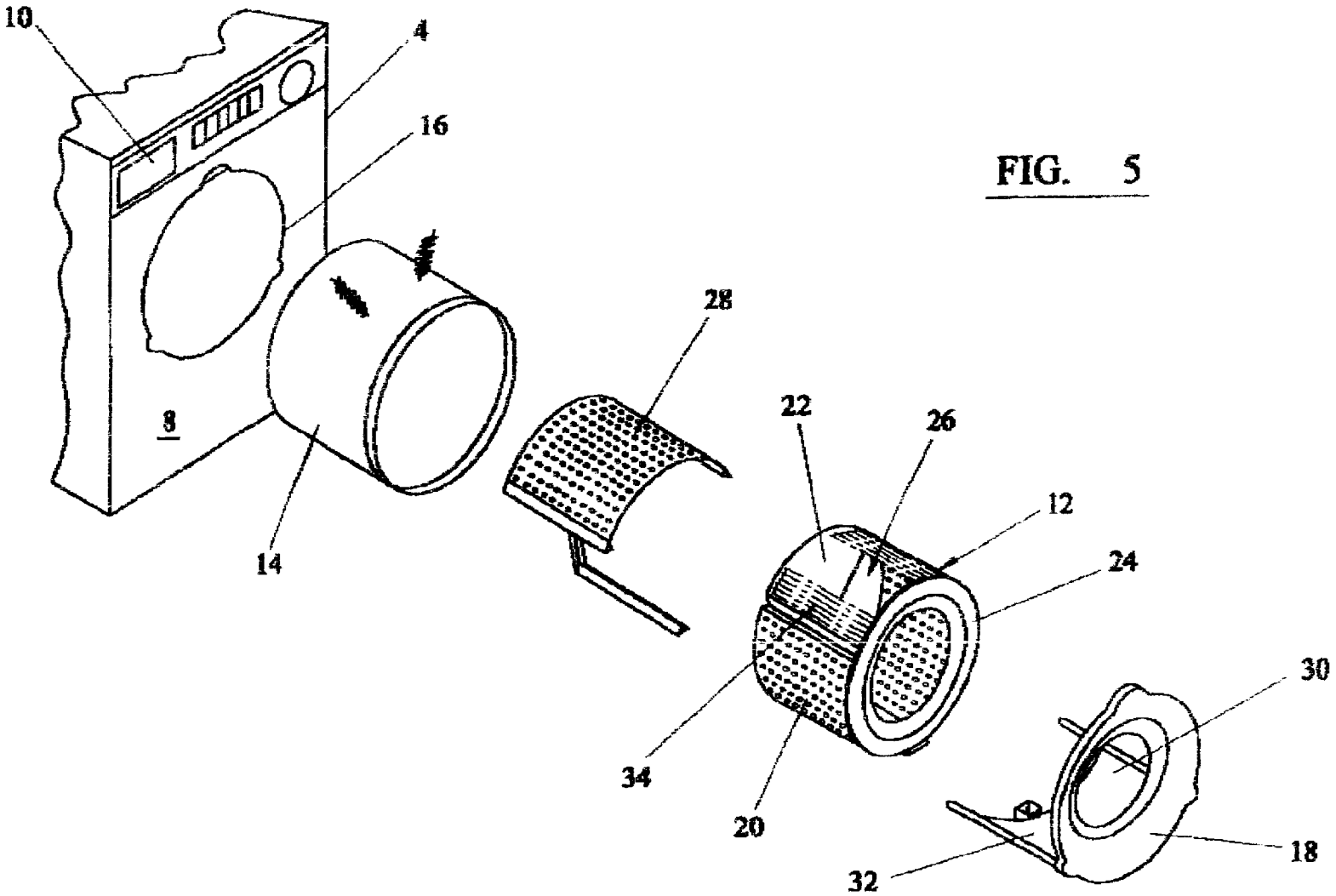
FIG. 5 shows an exploded view of the apparatus of FIGS. 1, 2 and 3.

Referring to FIGS. 2 and 5, drum (12) is composed of a curved side wall (20), a rear end wall (22) and forward end wall (24). Curved side wall (20) is formed from an appropriate sheet material, such as sheet stainless steel, which has been perforated or provided with plurality of apertures. Said perforations or apertures are of dimensions sufficiently small to prevent the passage of any item to be laundered through said aperture. It is preferred that said apertures are approximately 5–30 mm in the greatest dimension. Most preferably, and for ease of manufacture, said apertures are substantially circular.

Drum (12) is provided with an access aperture (26). Access aperture (26) is dimensioned so as to allow a user to place items to be laundered within the drum (12) and subsequently to withdraw them. It is most preferred that the aperture is at least 25 cm in the direction parallel to the longitudinal axis of the drum and 25 cm in the direction substantially circumferential to the drum.

Drum (12) may move from a withdrawn position to an extended position, said extended position on allowing the entire of aperture (26) to be accessed when the drum is in its extended position.

Aperture (26) is provided with an apparatus closure means (28). Aperture closure means (28) can be provided with means to cause aperture (26) to be opened when drum (12) moves into its extended position and aperture (26) to be closed by closure means (28) when the drum moves to its retracted position. Such means may be actuated by the movement of drum (12) between extended and withdrawn positions and vice versa.

Front end wall (24) is adapted to engage with port closure means (18). In the embodiment shown in FIGS. 2 and 5, front wall (24) is provided with a large substantially central aperture so as to enable viewing of the garments as they are laundered by way of a window (30) in closure means (18). Window (30) is optional and not necessary for the working of the present invention.

Drum (12) and port closure means (18) are engaged with each other (by means not shown) so that when drum (12) moves between its withdrawn position and its extended position, port closure means (18) simultaneously moves with drum (12). Attached to the lower edge of port closure means (18) is in extending drip tray (32) which, when the drum is in its extended position extends beneath the drum. This prevents excess liquid dropping onto the floor in front of the washing machine (2).

Aperture (26) in drum (12) may be provided with a further means for retaining the items to be laundered in addition to aperture closure means (28). That means is created from at least one portion of flexible netting (34). When aperture (26) is open, netting (34) is held at at least one side of aperture (26). When drum (12) is to be returned to its withdrawn position, netting (34) is attached across aperture (26).

The motive means for moving drum (12) between its withdrawn position and its extended position and vice versa may be provided by the user by gripping and pulling or pushing the handle, or maybe provided by electrical or hydraulic power which may be controlled by the control panel (10).

It is particularly preferred that means are provided (not shown) that prevents drum (12) moving between the withdrawn and extended positions unless aperture (26) is orientated as shown in FIG. 2.

In use, a user causes drum (12) to move to its extended position as shown in FIG. 2. The user then places the items to be laundered within drum (12) by way of aperture (26). Once drum (12) is either full or contains the desired quantity of items to be laundered, netting (34) is extended across aperture (26) by the user. The user then causes drum (12) to move to its withdrawn position. Movement of drum (12) to its withdrawn position causes aperture closure means (28) to close aperture (26). The laundering of the items is subsequently commenced.

Once the laundry has been completed, the items of laundry need to be removed. To do this, the user first causes the drum to move to the extended position. He then either turns by hand, or causes the washing machine (2) to turn the drum (12), until aperture (26) is in a position shown in FIG. 3, or, aperture (26) is at the vertically lowest position on drum (12). The laundry may then either be swept by the user's hand into a basket (36) placed beneath drum (12), or if the aperture (26) is at its lowest point, allowed simply to fall into basket (36). Once drum (12) is completely emptied, it is rotated so that aperture (26) is again in the position shown in FIG. 2. Further items to be laundered may then be placed into drum (12) and the process repeated, or drum (12) may simply be returned to its withdrawn position until the washing machine (2) is next required.

Figure 6:
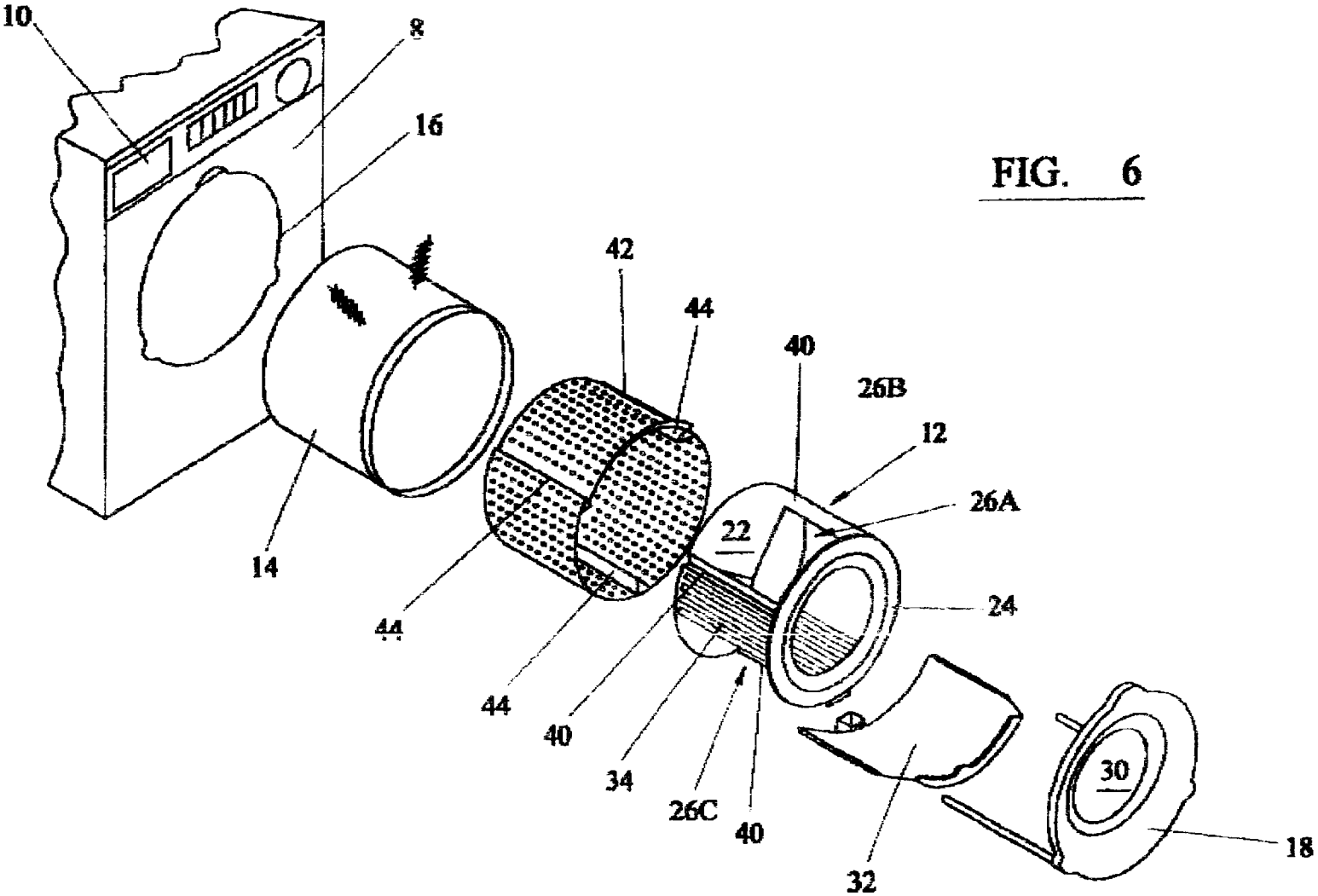
FIG. 6 shows an exploded view of the apparatus of FIGS. 1 and 4.

Referring to FIGS. 4 and 6, similar parts as shown in FIGS. 2, 3 and 5 are labelled with the same reference numerals in FIGS. 4 and 6. In the embodiment shown in FIGS. 4 and 6, drum (12) is formed from a rear wall (22) and a front wall (24). Extending between the walls (22,24) are three spacing elements (40). At least one panel of flexible netting (34) is attached to at least two spacing bars (40). The panels of flexible netting (34) are attached so that flexible netting (34) may be caused by a user to extend between each of spacer bars (40) substantially about the periphery of drum (12). Accordingly, the user can cause drum (12) to have three apertures (26*a*, 26*b*, 26*c*) when none of the panels of netting extend across an aperture.

In the embodiment shown in FIGS. 4 and 6, the apparatus of the present invention is further provided with a drum support sleeve (42). Drum support sleeve (42) is dimensioned to be a sliding fit around the outside of drum (12), and to engage with spacer bars (40) by way of internal ridges (44) in sleeve (42).

Sleeve (42) is made of appropriate materials such as stainless steel, and provided with a plurality of apertures or perforations. Said apertures or perforations should preferably be so configured that there can be no passage of items to be laundered through the perforations or apertures. Likewise, the netting (34) has holes that are not sufficiently large to allow the passage of items to be laundered.

In use, the apparatus shown in FIGS. 4 and 6 is used in substantially the same fashion as that previously described but it is not necessary to rotate drum (12) to unload the washing. In this embodiment, an aperture (26*c*) toward the bottom portion of the drum, is simply opened and the items that have been laundered may fall out.

Figure 7:
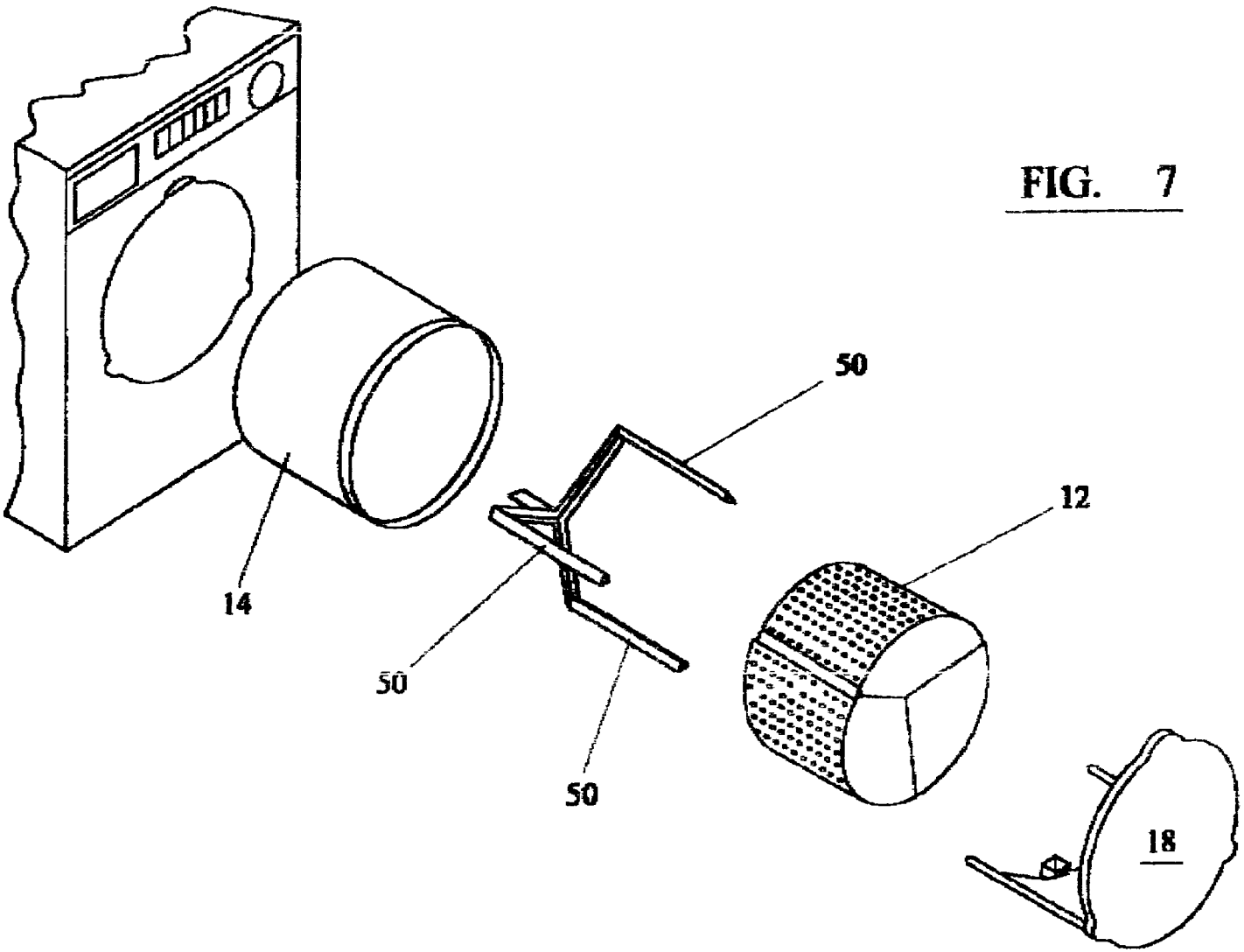
FIG. 7 shows a schematic arrangement of the apparatus of FIGS. 1–4 in exploded form.

In both of the embodiments described in FIGS. 1 to 6, drum (12) is supported within the water retaining means (14) by way of drum support bars (50), as shown in FIG. 7, but omitted from FIGS. 5 and 6 for sake of clarity. Support bars (50) engage with either the peripheral edges of drum end walls (22) and (24), or, in the case of the first above described embodiment with curved side wall (20) or spacer bars (40) in the second above described embodiment. Support bars (50) are telescopic and are caused to extend when drum (12) is moved from a withdrawn to an extended position.

Support bars (50) are located at substantially 120° C. spacing around the drum (12) and are mechanically linked to a motive means (not shown) that can cause support bars (50) and drum (12) to rotate about the longitudinal axis of the drum (12).

The drum (12) may be further provided with internal weirs (not shown) that will aid the agitation of the items to be laundered during the washing process. Said weirs can be incorporated with the means for engagement for support bars (50).

What is claimed is:

1. Laundry apparatus comprising an outer casing with a base, at least one side wall, and a top, within which are located a receptacle for receiving items to be laundered, an arrangement for agitation of said items, a liquid retention device at least partially surrounding said receptacle, and a control system; wherein said receptacle is a single-piece drum having opposing first and second end walls with a substantially fully curved side wall therebetween, the liquid retention device and a side wall of the apparatus are provided with aligned ports through which an end portion of the drum may reversibly travel between a retracted position and an extended position, distance of travel of the drum out of the side wall to the extended position being sufficient to allow access to at least one aperture provided in the curved side wall of the drum, said curved side wall of said drum being substantially parallel to the direction of travel of the drum, said aperture being configured and dimensioned to allow insertion and removal of items to be laundered, and the direction of travel of the drum being substantially parallel to the longitudinal axis of the drum.

2. Laundry apparatus according to claim 1 in which the drum is comprised of a curved wall and a first and second end wall, a portion of at least one of the walls being adapted to allow the passage of liquid through that portion of the wall.

3. Laundry apparatus according to claim 2 in which a portion of at least one of the walls of the drum is formed from netting, wire mesh, perforated metal sheet, or metal sheet provided with apertures.

4. Laundry apparatus according to claim 1 in which the drum is substantially cylindrical.

5. Laundry apparatus according to claim 1 in which one or both of the drum and the alined ports are configured so that a portion of the drum can only travel through the alined ports when the drum has a predetermined orientation relative to the outer casing.

6. Laundry apparatus according to claim 5 in which the predetermined orientation is one in which the aperture in the drum is in the portion of the drum closest to the top of the outer casing.

7. Laundry apparatus according to claim 1 in which the drum may rotate about an axis substantially parallel to the direction of travel of the drum when the drum is in the extended position.

8. Laundry apparatus according to claim 1 in which at least one aperture in the drum is provided with a means to close that aperture when the drum is in the withdrawn position.

9. Laundry apparatus according to claim 8 in which the or each aperture closure means is actuated by the drum travelling between the withdrawn and extended positions.

10. Laundry apparatus according to claim 1 in which the apparatus is a washing machine, a tumble dryer, or a combined washing machine and tumble dryer.

* * * * *